US008944531B2

(12) United States Patent
Wyman et al.

(10) Patent No.: US 8,944,531 B2
(45) Date of Patent: Feb. 3, 2015

(54) CONTAINER ASSEMBLY MOUNTABLE TO A DOOR

(75) Inventors: Troy Alan Wyman, Grand Rapids, MI (US); Steven Cochrane, Grand Rapids, MI (US); Benjamin Patrick Hummel, Rockford, MI (US)

(73) Assignee: ODL, Incorporated, Zeeland, MI (US)

( * ) Notice: Subject to any disclaimer, the term of this patent is extended or adjusted under 35 U.S.C. 154(b) by 42 days.

(21) Appl. No.: 13/605,912

(22) Filed: Sep. 6, 2012

(65) Prior Publication Data

US 2014/0062276 A1 Mar. 6, 2014

(51) Int. Cl.
*A47B 67/02* (2006.01)
*A47F 5/08* (2006.01)

(52) U.S. Cl.
USPC ..... 312/245

(58) Field of Classification Search
USPC ..... 312/321.5, 245, 242
See application file for complete search history.

(56) References Cited

U.S. PATENT DOCUMENTS

| | | | | | |
|---|---|---|---|---|---|
| 1,035,015 | A | * | 8/1912 | Johnson | 312/114 |
| 1,581,776 | A | * | 4/1926 | Altschul | 211/4 |
| 1,673,291 | A | * | 6/1928 | Matchette | 232/43.4 |
| 1,738,539 | A | * | 12/1929 | Moss | 232/1 E |
| 2,893,076 | A | | 7/1959 | Herts | |
| 3,822,925 | A | * | 7/1974 | Osroff | 312/242 |
| 3,871,434 | A | * | 3/1975 | Hance | 160/91 |
| 3,990,185 | A | | 11/1976 | Nagase | |
| 4,094,416 | A | | 6/1978 | Smith | |
| 4,361,368 | A | | 11/1982 | Daniels | |
| 4,839,989 | A | * | 6/1989 | McConnell | 49/171 |
| 5,050,749 | A | | 9/1991 | Scaglione | |
| 5,066,079 | A | | 11/1991 | Lawrence | |
| 5,269,097 | A | * | 12/1993 | Davlantes | 49/169 |
| 5,469,903 | A | | 11/1995 | Stanley | |
| 5,607,214 | A | | 3/1997 | Pierce et al. | |
| 5,681,100 | A | | 10/1997 | Powell | |
| 5,927,840 | A | | 7/1999 | Bzowski | |
| 6,238,030 | B1 | | 5/2001 | Matselboba | |

(Continued)

FOREIGN PATENT DOCUMENTS

| | | |
|---|---|---|
| WO | 9413175 | 6/1994 |
| WO | 2009035800 A1 | 3/2009 |

OTHER PUBLICATIONS

Pet Door Installation Problems, http://www.petdoors.com/installation-problems.html, Aug. 19, 2011, petdoors.com.*

(Continued)

*Primary Examiner* — Darnell Jayne
*Assistant Examiner* — Timothy M Ayres
(74) *Attorney, Agent, or Firm* — Barnes & Thornburg LLP

(57) ABSTRACT

A container assembly may include a container having a side wall defining and circumscribing a container interior, a first frame extending from and about the side wall and defining an outer terminal portion sized and configured to abut a door about an opening formed therein, a second frame defining an outer terminal portion sized and configured to abut the door about the opening and an inner terminal portion sized and configured to extend over at least a portion of the opening about a periphery of the opening, and at least a first fixation member to secure the first frame to the second frame with the container extending into the opening and with a portion of the door adjacent to the opening positioned between the outer terminal portions of the first and second frames to clamp the container assembly to the door about the opening.

26 Claims, 10 Drawing Sheets

(56) References Cited

U.S. PATENT DOCUMENTS

| | | | | |
|---|---|---|---|---|
| 6,361,130 | B1 | 3/2002 | Kardy | |
| 6,457,278 | B1 | 10/2002 | Fleming | |
| 6,634,727 | B2 | 10/2003 | Torres | |
| 7,198,835 | B2 | 4/2007 | Anderson | |
| 7,204,569 | B2 | 4/2007 | Walburn | |
| D607,578 | S | 1/2010 | Smithline | |
| 7,651,178 | B2 | 1/2010 | Greiner | |
| 7,886,486 | B2 * | 2/2011 | Lomax et al. | 49/169 |
| 2003/0085641 | A1 | 5/2003 | Matselboba | |
| 2006/0269720 | A1 | 11/2006 | Guanci | |
| 2008/0030002 | A1 | 2/2008 | Jakins et al. | |
| 2008/0184625 | A1 * | 8/2008 | Bjorholm et al. | 49/371 |
| 2009/0200903 | A1 | 8/2009 | Tassin et al. | |
| 2009/0272707 | A1 | 11/2009 | Layton | |
| 2010/0307059 | A1 | 12/2010 | Oberbroeckling | |
| 2011/0219693 | A1 * | 9/2011 | Bosserdet, Jr. | 49/168 |

OTHER PUBLICATIONS

How to Install a Cat Door in a Hollow Core Door, http://homeguides.sfgate.com/install-cat-door-hollow-core-door-25681.html, Apr. 28, 2012, homeguides.com.*

* cited by examiner

CONTAINER ASSEMBLY MOUNTABLE TO A DOOR

FIELD OF THE INVENTION

This disclosure relates generally to containers, and more specifically to storage containers, e.g., short-term and/or organization containers, mountable to doors for residential or commercial use.

BACKGROUND

Organization space in residential dwellings and/or in commercial buildings, and short-term storage space specifically, may be limited or, in some cases, non-existent. Even in dwellings or facilities that seemingly have sufficient bulk storage space, short-term storage space for some items may still be limited in some rooms such as kitchens, closets, bedrooms, bathrooms, utility rooms and/or garages. Storage space can be gained in such rooms by integrating short-term storage containers into the existing infrastructure of the dwelling or commercial building.

SUMMARY

This disclosure may comprise one or more of the features recited in the attached claims, and/or one or more of the following features and combinations thereof. In one embodiment, a container assembly may comprise a container having a side wall defining and circumscribing a container interior, and the container may be sized to pass through an opening defined through a door. A first frame may extend from and about the side wall and define an outer terminal portion sized and configured to abut the door about the opening. A second frame may define an outer terminal portion sized and configured to abut the door about the opening and an inner terminal portion sized and configured to extend over at least a portion of the opening about a periphery of the opening. At least a first fixation member may secure the first frame to the second frame with the container extending into the opening and with a portion of the door adjacent to the opening positioned between the outer terminal portions of the first and second frames to clamp the container assembly to the door about the opening.

In the container assembly described in the preceding paragraph, an inner portion of the first frame may extend along and be attached to an outer surface of the side wall, and a combination of the container and the inner portion of the first frame may be sized to pass through the opening defined through the door.

In the container assembly described in any of the preceding paragraphs, the first frame may be integral with the side wall such that the first frame and the side wall together form a unitary structure.

In the container assembly described in any of the preceding paragraphs, the side wall may define a front face and a rear face with the container interior defined between the front and rear faces, and the container may comprise a panel defining a terminal wall of the container interior. The panel in this configuration may be one of attached to one of the front face and rear face of the side wall and integral with one of the front face and rear face of the side wall.

In the container assembly described in any of the preceding paragraphs, the side wall may define a front face and a rear face with the container interior defined between the front and rear faces. The container may comprise at least one door or soft covering mounted to the side wall at or adjacent to at least one of the front face and the rear face.

In the container assembly described in any of the preceding paragraphs, the container assembly may comprise at least one shelf support member configured to support at least one shelf positioned within the container interior.

In the container assembly described in any of the preceding paragraphs, the first and second frames may be configured to receive the at least a first fixation member such that the at least a first fixation member secures the first frame to the second frame without contacting the door and without contacting the container.

In the container assembly described in any of the preceding paragraphs, the container assembly may further comprise a third frame to overlay and cover the second frame, and at least a second fixation member to secure the third frame to the second frame. In this configuration, the container assembly may further comprise a panel sized to be received between the second and third frames, with the second and third frames configured to trap the panel therebetween. The third frame may, for example, define an outer terminal portion sized and configured to abut the door about the outer terminal portion of the second frame, and an inner terminal portion sized and configured to contact the panel and trap the panel against the inner terminal portion of the second frame about the inner terminal portion of the second frame. The panel may, for example, define an outer periphery, and the inner terminal portion of the second frame may be configured to abut one surface of the panel about the outer periphery thereof and the inner terminal portion of the third frame may be configured to abut an opposite surface of the panel about the outer periphery thereof. In any case, the panel may generally be one of a chalk board, a magnetic chalk board, a white board, and a transparent panel. In any example of the container assembly described in this paragraph, the container assembly may further comprise a sealing medium disposed between the panel and at least one of the second and third frames to form a seal between the panel and the at least one of the second and third frames. In any example of the container assembly described in the preceding paragraph, the at least a second fixation member may be integral with at least one of the second frame and the third frame.

In the container assembly described in any of the preceding paragraphs, the container assembly the door may be a hollow core door, and the container assembly may further comprise at least one support member sized to be received within the hollow core at least partially about the opening defined through the door. The at least one support member to maintain a thickness of the hollow core constant adjacent to and along the opening defined through the door with the at least a first fixation member securing the first frame to the second frame. The hollow core door described in this paragraph may include a spacing member positioned therein to maintain the thickness of the hollow core consistent across the hollow core door, and the at least one support member may comprise a spacing member displacement portion configured to displace the spacing member from the opening defined through the door as the at least one support member is received within the hollow core door.

In the container assembly described in any of paragraphs [0003]-[0010], the door may be a hollow core door, the container assembly may further comprise the door, and the door may comprise first and second door skins with inner surfaces affixed to a first rail along top edges thereof, to a second rail along bottom edges thereof, and to opposing stiles along opposite side edges thereof, the door may define a hollow core between the first and second door skins, the first and second rails and the opposing stiles, and the hollow core may define a thickness between the inner surfaces of the first and second door skins.

In the container assembly described in the preceding paragraph, the container assembly may further comprise at least one support member configured to be inserted within the hollow core at least partially about the opening defined through the door, wherein the at least one support member to maintain the thickness of the hollow core constant adjacent to and along the opening defined through the door with the at least a first fixation member securing the first frame to the second frame.

In the container assembly described in the preceding paragraph, the at least one support member may comprise a cap having a width that is greater than the thickness of the hollow core and less than or equal to a thickness of the door defined between outer surfaces of the first and second skins, and a door insertion portion extending from the cap, and the door insertion portion may be configured to extend into the hollow core with the cap abutting the first and second door skins. In any case, the opening defined through the door may, for example, be a rectangular opening having a top, a bottom, a first side between the top and bottom, and a second side between the top and bottom and opposite the first side, and the at least one support member may comprise a first support member configured to be inserted into the hollow core along the top of the rectangular opening and between the first and second sides, a second support member configured to be inserted into the hollow core along the bottom of the rectangular opening and between the first and second sides, a third support member configured to be inserted into the hollow core along the first side and between the top and bottom, and a fourth support member configured to be inserted into the hollow core along the second side and between the top and bottom.

In the container assembly described in paragraph [0013], the door may comprise a spacing member positioned within the hollow core to maintain the thickness of the hollow core consistent across the hollow core door, and the at least one support member may comprise a spacing member displacement portion configured to displace the spacing member from the opening defined through the door when the at least one support member is inserted into the hollow core. In this implementation, the at least one support member may comprise a cap having a width that is greater than the thickness of the hollow core and less than or equal to a thickness of the door defined between outer surfaces of the first and second skins, and a door insertion portion extending from the cap, the door insertion portion defining the spacing member displacement portion, and the door insertion portion may be configured to extend into the hollow core with the spacing member displacement portion displacing the spacing member from the opening defined through the door and with the cap abutting the first and second door skins.

In the container assembly described in paragraph [0012], the door may comprise at least one frame member affixed to the inner surfaces of the first and second door skins and positioned relative to the first and second door skins such that the at least one frame member extends at least partially about, at or near, the opening when the opening is defined through the door.

In the container assembly described in paragraph [0012], the opening defined through the door may be a rectangular opening having a top, a bottom, a first side between the top and bottom, and a second side between the top and bottom and opposite the first side, and the at least one frame member may comprise a first frame member extending along and substantially coterminous with the top of the opening when the opening is defined through the door, a second frame member extending along and substantially coterminous with the bottom of the opening when the opening is defined through the door, a third frame member extending along and substantially coterminous with the first side of the opening when the opening is defined through the door, and a fourth frame member extending along and substantially coterminous with the second side of the opening when the opening is defined through the door. The first and second frame members may be each joined to each of the third and fourth frame members. Alternatively, none of the first, second, third and fourth frame members may be joined with any others of the first, second, third and fourth frame members. Alternatively still, at least one of the first, second, third and fourth frame members may be joined to another one of the first, second, third and fourth frame members.

In the container assembly described in any of the preceding paragraphs, the side wall may comprises a top panel, a bottom panel, a first side wall and a second side wall, and the top and bottom panels may each joined to or integral with each of the first and second side walls to form a rectangular container.

In another embodiment, an assembly may comprise a first frame defining an outer terminal portion sized and configured to abut the door about the opening and an inner terminal portion sized and configured to extend over at least a portion of the opening about a periphery of the opening, a second frame defining an outer terminal portion sized and configured to abut the door about the opening and an inner terminal portion sized and configured to extend over at least a portion of the opening about the periphery of the opening, and at least a first fixation member to secure the inner terminal portion of the first frame to the inner terminal portion of the second frame with a portion of the door adjacent to the opening positioned between the outer terminal portions of the first and second frames to clamp the assembly to the door about the opening.

In the assembly described in the preceding paragraph, the assembly may further comprise a third frame to overlay and cover the first frame, and at least a second fixation member to secure the third frame to the first frame.

In the assembly described in the preceding paragraph, the assembly may further comprise a first panel sized to be received between the first and third frames, and the first and third frames may be configured to trap the first panel therebetween. The assembly described in this paragraph may further comprise a sealing medium disposed between the first panel and at least one of the first and third frames to form a seal between the first panel and the at least one of the first and third frames. In any implementation of the assembly described in this paragraph, the first panel may be one of a chalkboard, a magnetic chalk board, a white board, and a transparent panel.

In the assembly described in the paragraph [0020], the third frame may define an outer terminal portion sized and configured to abut the door about the outer terminal portion of the first frame, and an inner terminal portion sized and configured to contact the first panel and trap the first panel against the inner terminal portion of the first frame about the inner terminal portion of the first frame.

In the assembly described in the paragraph [0020], the at least a second fixation member may be integral with at least one of the first frame and the third frame.

In the assembly described in the paragraph [0020], the assembly may further comprise a fourth frame to overlay and cover the second frame, and at least a third fixation member to secure the fourth frame to the second frame.

In the assembly described in the preceding paragraph, the assembly may further comprise a second panel sized to be received between the second and fourth frames, and the second and fourth frames may be configured to trap the second panel therebetween.

In the assembly described in the preceding paragraph, the assembly may further comprise a sealing medium disposed between the second panel and at least one of the second and fourth frames to form a seal between the second panel and the at least one of the second and fourth frames.

In the assembly described in paragraph [0025], the second panel may be one of a chalkboard, a magnetic chalk board, a white board, and a transparent panel.

In the assembly described in paragraph [0025], the fourth frame may define an outer terminal portion sized and configured to abut the door about the outer terminal portion of the second frame, and an inner terminal portion sized and configured to contact the second panel and trap the second panel against the inner terminal portion of the second frame about the inner terminal portion of the second frame.

In the assembly described in paragraph [0024], the at least a third fixation member may be integral with at least one of the second frame and the fourth frame.

DESCRIPTION OF THE ILLUSTRATIVE EMBODIMENTS

For the purposes of promoting an understanding of the principles of the invention, reference will now be made to a number of illustrative embodiments shown in the attached drawings and specific language will be used to describe the same.

This disclosure is directed to a container assembly that is mountable to any type of door that may be installed in, or that is installed in, a residential or commercial application. An embodiment of such a container assembly is described in detail below with respect to FIGS. 10-13. Example doors in which the container assembly described in this disclosure may be mounted include, but should not be limited to, interior or exterior doors in residential and/or commercial applications such as doors for kitchens, bathrooms, pantries, closets, garages, utility rooms or other such applications. In any case, an opening is first defined through the door, and the container assembly is mounted to the door through and about the defined opening. In the embodiments illustrated and described herein, the container assembly includes a container and a pair of frames that are configured to clamp the container to the door about the opening defined through the door. While the door in which the container assembly is mounted should not be limited to any specific type of construction, hollow core doors present a challenge with the container mounting arrangement described herein. More specifically, the door skins of some hollow core doors may not be able to withstand the clamping pressure of the container mounting assembly described herein without some amount of deformation.

As will be described in detail below, some embodiments of the container assembly mountable to hollow core doors may therefore further include the hollow core door with one or more support members configured to be received within the hollow core at least partially about the opening in which the container is to be mounted, or with one or more frame members affixed to the door skins inside the door during its construction and positioned such that the one or more frame members, is/are at or near, the opening when the opening is formed. Such one or more support members and/or one or more frame members are provided to maintain the thickness of the hollow core constant adjacent to and along the opening when the container assembly is mounted to the door about the opening.

Figure 1:
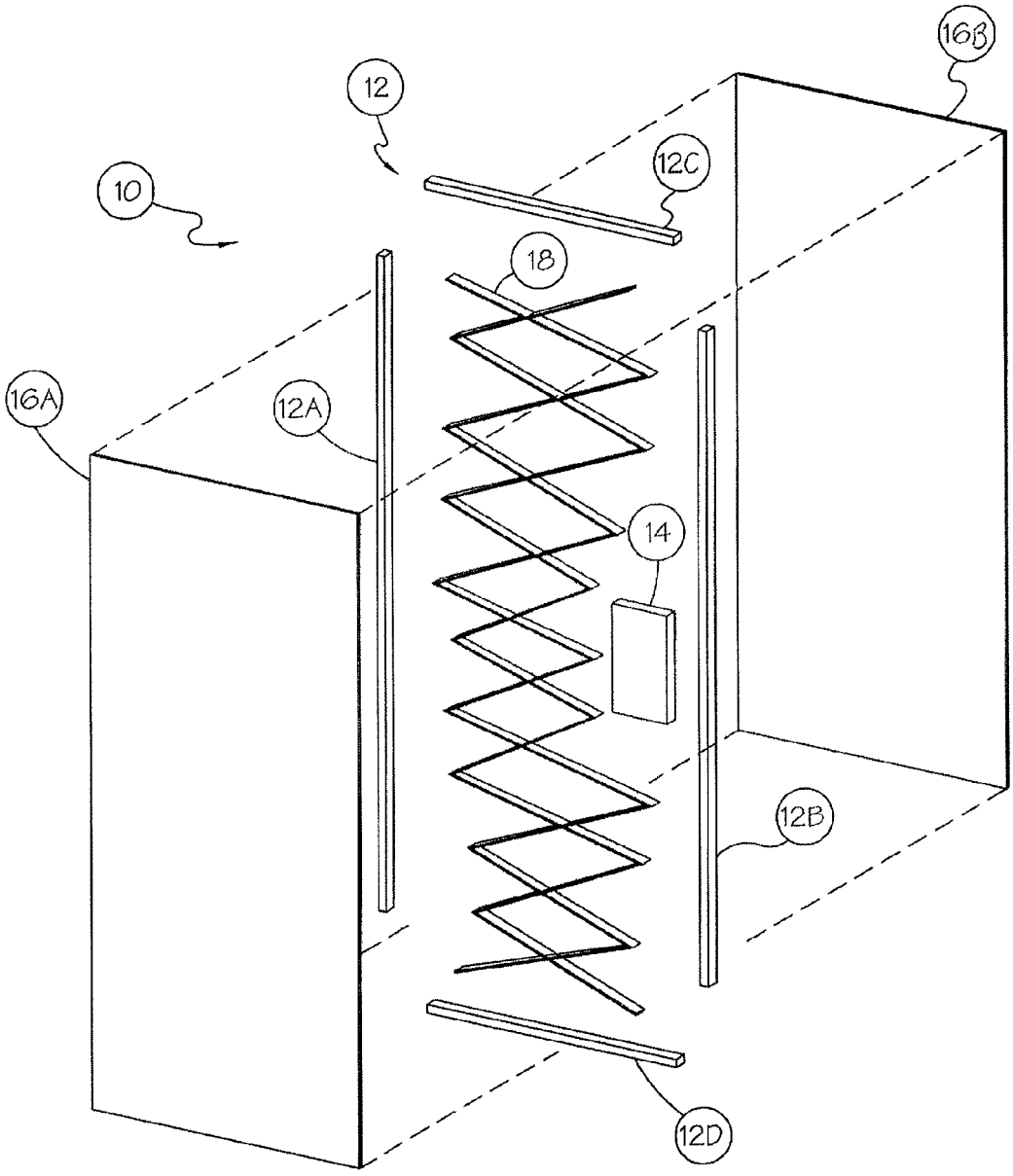
FIG. 1 (PRIOR ART)
FIG. 1 is an exploded perspective view of a conventional hollow core door.

Referring now to FIG. 1, an exploded perspective view of a conventional hollow core door 10 is shown. In the illustrated embodiment, the door 10 includes framing 12 about which two opposing door skins 16A and 16B are mounted. In some embodiments, a spacing member 18 is positioned within the hollow core bounded by the framing 12 and the two door skins 16A and 16B. The spacing member 18 is typically provided for the purpose of maintaining the thickness of the hollow core generally consistent across the surfaces of the door skins 16A, 16B, e.g., to prevent the door skin 16A and/or the door skin 16B from sinking or otherwise deforming inwardly in areas of the door 10 remote from the framing 12. The spacing member 18 may be provided in any configuration and may be formed of any material capable of performing the function just described. In typical embodiments, the spacing member 18 is formed of a lightweight material that is flexible or semi-flexible in directions parallel to the plane defined by the door skins 16A and 16B but is substantially rigid in directions perpendicular to the plane defined by the door skins 16A and 16B. Examples of such material may typically include, but is not limited to, corrugated cardboard, corrugated or otherwise reinforced natural or synthetic material, or the like. The spacing member 18 may typically be referred to in the door fabrication industry as "corrugate."

In any case, the framing 12 illustrated in FIG. 1 includes a pair of stiles 12A, 12B spaced apart by, and each connected to, a top rail 12C and a bottom rail 12D. A lock block 14 is typically positioned adjacent to one of the stiles, e.g., the stile 12B, to provide for attachment thereto of a conventional door handle and/or lockset. The door skin 16A is attached to one side of the framing 12 and to one side of the lock block 14, and the door skin 16B is attached to the opposite side of the framing 12 and to the opposite side of the lock block 14, with the spacing member 18 trapped within the hollow core defined and bounded by the framing 12 and the two door skins 16A and 16B. The door skins 16A, 16B are typically attached to the framing 12 such that the outer perimeter of each is coterminous with the outer edge of each stile 12A, 12B and with the outer edge of each rail 12C, 12D. In some embodiments, the framing components 12A, 12B, 12C, 12D and the lock block 14 are formed of wood, although in other embodiments at least one or more of the framing components 12A, 12B, 12C, 12D may be formed of or include one or more synthetic or other organic materials. The door skins 16A, 16B are, in some embodiments, formed of wood veneers, although one or both of the door skins 16A, 16B may in other embodiments be formed of or include one or more synthetic or other organic materials. The door skins 16A, 16B are typically affixed to the framing components 12A, 12B, 12C, 12D and to the lock block 14, and in some embodiments to the spacing member 18, via a conventional adhesive, although other conventional affixing or attachment methods and/or components may alternatively be used.

Figure 2:
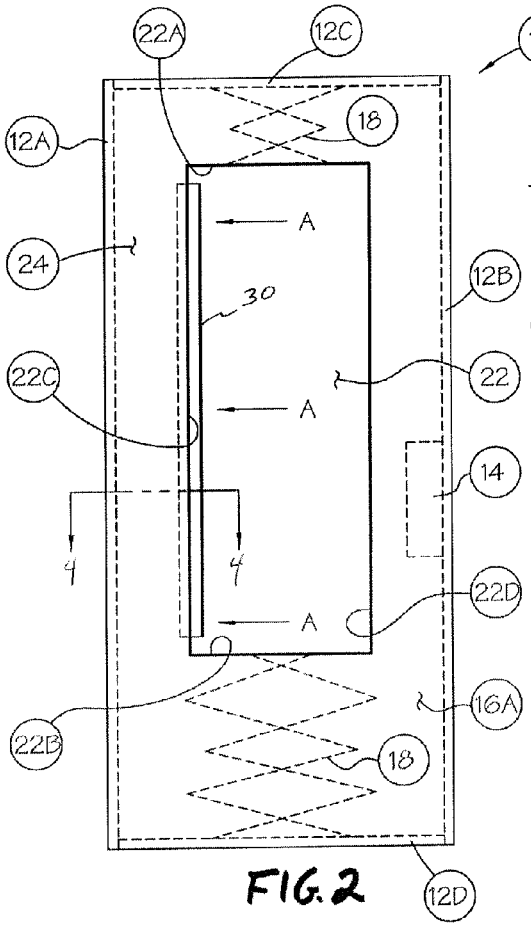
FIG. 2 is a front plan view of the door of FIG. 1 shown with a support member inserted into the hollow core along one edge of the opening.

Referring now to FIG. 2, a front plan view of the door 10 of FIG. 1 is shown with a portion of the door 10 removed, e.g., cut away, to form an opening 22 through the door 10 in preparation for mounting thereto of a container assembly of the type illustrated and described herein. In the embodiment illustrated in FIG. 2, the opening 22 formed through the door 10 is rectangular in shape in order to receive therein a rectangularly-shaped embodiment of a container assembly illustrated by example in FIGS. 9-18, and the opening 22 thus has a top edge 22A, a bottom edge 22B opposite the top edge 22A, and two opposing side edges 22C, 22D extending between the top and bottoms edges 22A, 22B respectively. It will be appreciated that the opening 22 may alternatively be formed in any geometric shape, and that any such shape of the opening 22 will generally be dictated by the shape of the container assembly to be mounted to the door 10. In any case, removal of the portion of the door 10 to form the opening 22 exposes the hollow core 24 of the door 10 about the perimeter of the opening 22. Generally, the thickness of the hollow core 24, i.e., the distance between the opposing inner surfaces of the door skins 16A, 16B, is determined by the thicknesses, i.e., in a direction perpendicular to the plane defined by the door skins 16A, 16B, of the stiles 12A, 1B and the rails 12C, 12D. Generally, the thickness of the key block 14 is selected to be identical to that of the components of the framing 12.

At some locations of one or more terminal edges of the opening 22, the spacing member 18 is coterminous with the door skins 16A, 16B, and two such locations along each of to top and the bottom edges 22A, 22B of the opening 22 are shown in FIG. 2. It will be understood that the shape, placement and/or coverage of the spacing member 18 may vary from door 10 to door 10, and that the placement of the spacing member 18 may even vary from door 10 to door 10 in embodiments using identical spacing members 18. The locations of the spacing members 18 shown in FIG. 2 are therefore illustrated only by way of example, and the spacing member 18 may alternatively co-terminate with the door skins 16A, 16B at one or more locations along any exposed edge 22A, 22B, 22C, 22D of the opening 22.

Figure 18:
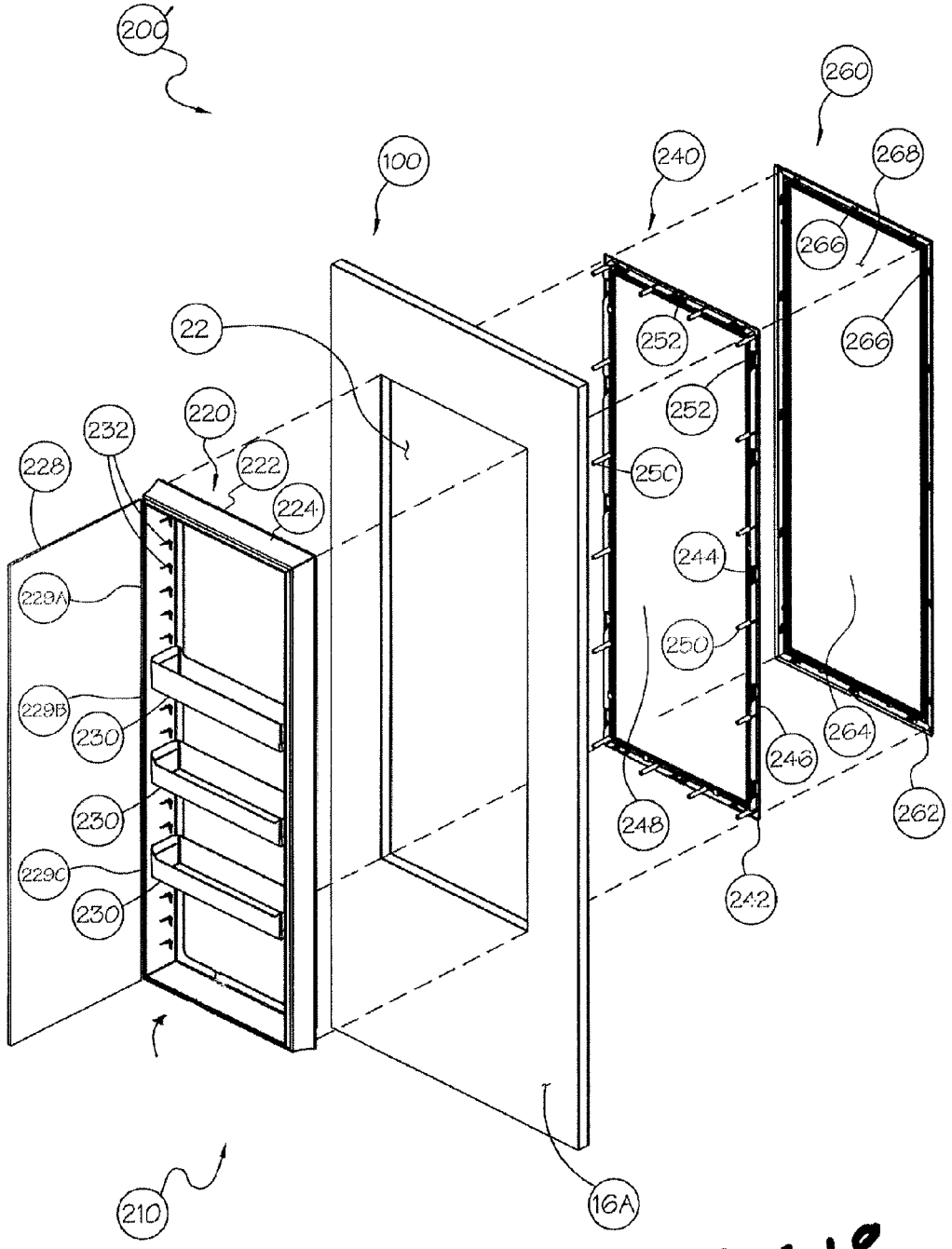
FIG. 18 is an exploded perspective view of an alternate embodiment of a container assembly mountable to a door.
Figure 19:
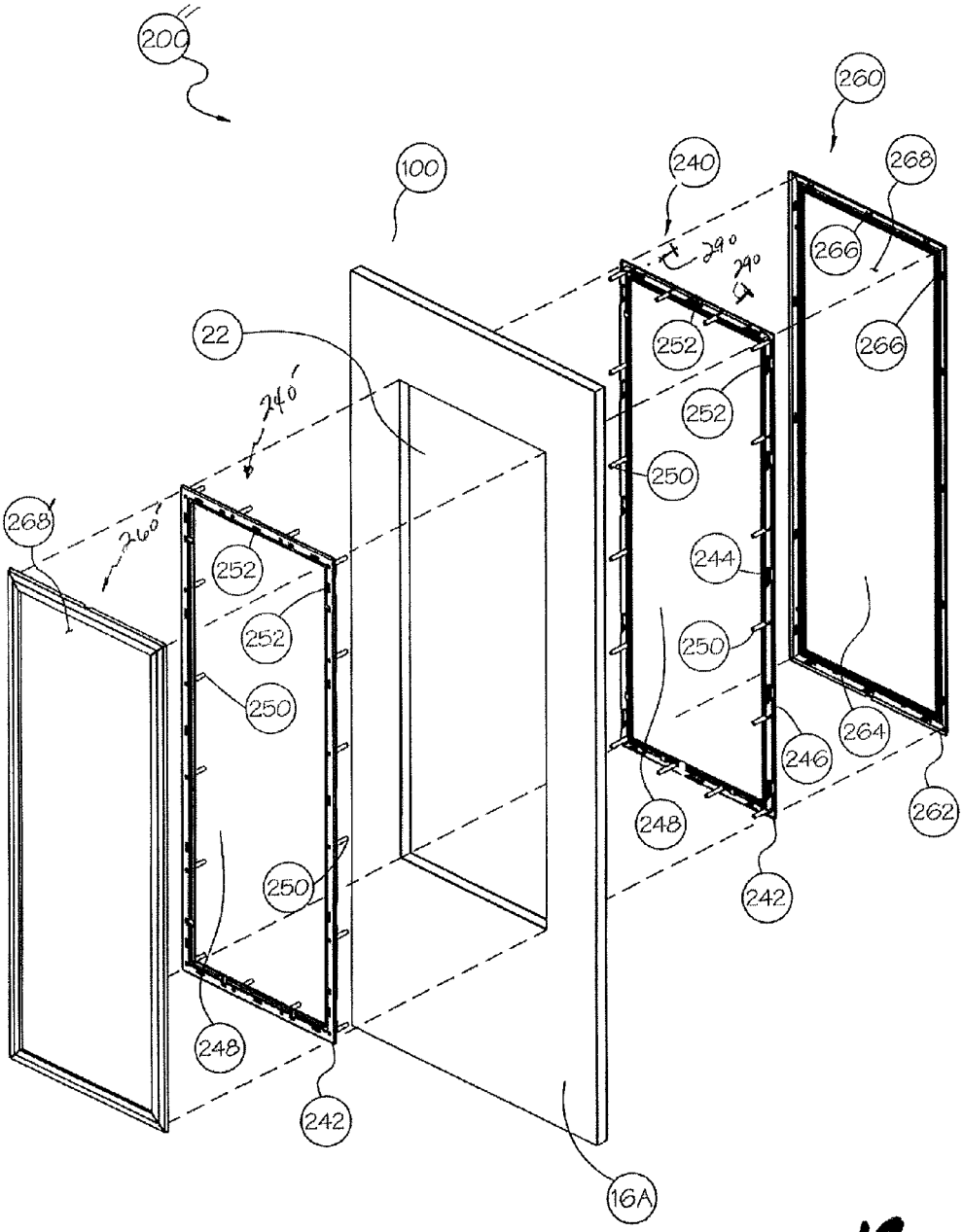
FIG. 19 is an exploded perspective view of another embodiment of an assembly mountable to a door.

In the embodiment illustrated in FIG. 2, the framing components 12A, 12B, 12C, 12D, the lock block 14, and the spacing member 18 are shown in phantom and are therefore represented with dashed lines. Also in the embodiment illustrated in FIG. 2, an elongated support member 30 is shown being inserted into the hollow core 24 along the edge 22C of the opening 22 in the direction of arrows A. The support member 30, when inserted into the hollow core 24 of the door 10 along the edge 22C of the opening, provides support between the door skins 16A and 16B along the edge 22C and maintains the thickness of the hollow core 24 of the door 10 constant adjacent to and along the edge 22C of the opening 22 when the container assembly of the type illustrated in FIGS. 19-18 is mounted, e.g., clamped, to the door 10 about the opening 22.

Figure 3:
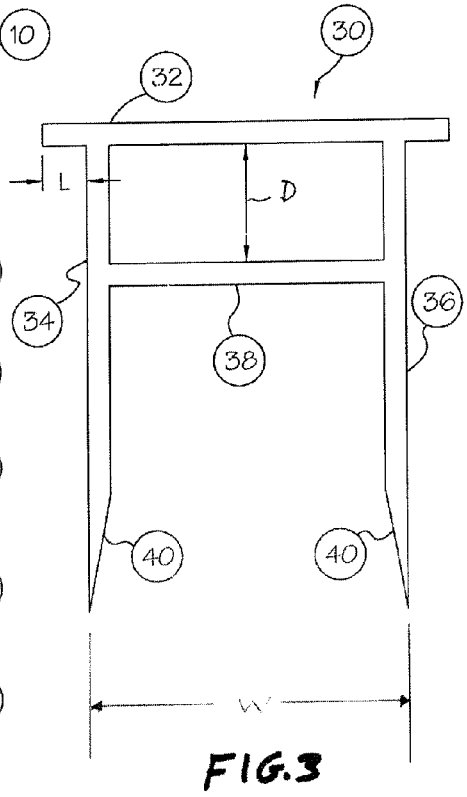
FIG. 3 is an end view of an embodiment of the support member shown in FIG. 3.

Referring now to FIG. 3, an end view of an embodiment of the support member 30, i.e., as viewed along a longitudinal axis defined by the support member 30, is shown. In the illustrated embodiment, the support member 30 defines a substantially flat cap 32 positioned over and attached to, or integral with, a door insertion portion which includes a pair of substantially flat legs 34, 36 and a substantially flat cross member 38. One leg 34 extends generally perpendicularly away from the cap 32 adjacent to one end thereof, and the other leg 36 likewise extends generally perpendicularly away from the cap 32 adjacent to an opposite end thereof, and the legs 34 and 36 are generally parallel with each other. The cross member 38 is attached at one end to, or is integral with, one leg 34, and is attached at an opposite end to, or is integral with, the other leg 36. The cross member 38 is arranged generally perpendicularly to the legs 34, 36 and is therefore generally parallel with, but spaced apart from, the cap 32.

In one embodiment, as illustrated in FIG. 3, each leg 34, 36 is tapered toward its terminal end such that the thickness of each leg 34, 36 at its terminal end is substantially reduced relative to the thickness adjacent to the cross member 38. The tapered region of each leg 34, 36 defines a spacing member displacement portion 40 configured to displace, as the support member 30 is inserted into the edge 22A (or 22B, 22C or 22D) of the opening 22, any part or section of the spacing member 18 that may occupy the hollow core 24 about the edge 22A (or 22B, 22C or 22D) of the opening 22. In one embodiment, the terminal ends of the spacing member displacement portion 40 are sufficiently sharp to cut into or away any part or section of the spacing member 18 in its path, or to otherwise displace the part or section of the spacing member 18 from the door skins 16A, 16B, as the support member 30 is inserted in to the edge 22A (or 22B, 22C or 22D) of the opening 22 defined through the door 10. It will be appreciated that in embodiments in which any part or section of the spacing member 18 that may occupy the hollow core 24 about the edge 22A, 22B, 22C or 22D is nonexistent or is removed by other means, the legs 34, 36 need not be tapered as shown in FIG. 3.

In any case, the distance between the outer surfaces (i.e., non-opposing surfaces) of the legs 34, 36 defines a width, W, and each end of the cap 32 extends beyond the outer surface of each leg 34, 36 by a length L. Opposing surfaces of the cap 32 and the cross member 38 are spaced apart by a distance D.

Figure 4:
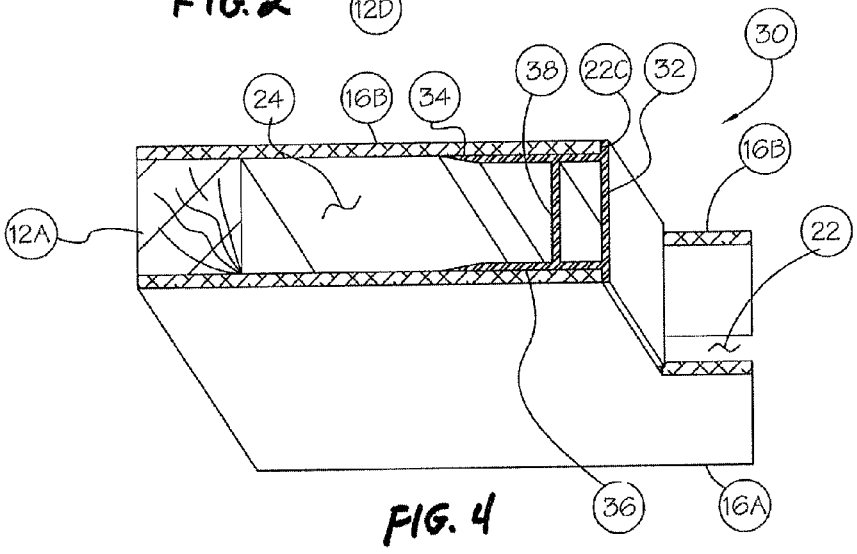
FIG. 4 is a cross-sectional perspective view of the door and support member of FIG. 2 viewed along section lines 4-4.

Referring also now to FIG. 4, a cross-sectional perspective view is shown of the door 10 with the support member 30 of FIG. 3 inserted therein, as viewed along section lines 4-4 of FIG. 2. As illustrated in FIG. 4, the support member 30 has been inserted into the edge 22C of the opening 22 and into hollow core 24 defined between the stile 12A and the door skins 16A, 16B in the direction indicated by the arrows A in FIG. 3, and has been advanced into the hollow core 24 until the inner surfaces of the portions of the cap 32 that extend beyond the legs 34, 36 abut the edge 22C of the opening 22, i.e., the edges of the door skins 16A, 16B which define the edge 22C of the opening 22. In one embodiment, the width W defined between the outer surfaces of the legs 34, 36 is selected to be the same as, or just less than, the thickness of the hollow core 24, i.e., the distance between the inner surfaces of the door skins 16A, 16B of the door 10, such that the support member 30 frictionally engages the inner surfaces of the doors skins 16A, 16B when the support member 30 is inserted into the hollow core 24 at the edge 22C of the opening 22 as shown in FIG. 4. In some embodiments, such a frictional engagement is sufficient to maintain the support member 30 in position as illustrated in FIG. 4, although other embodiments are contemplated in which a conventional adhesive may be applied to one or more surfaces of the support member 30, or one or more other conventional attachment mechanisms and/or methods may be used, to affix, attach or otherwise secure the support member 30 to either or both of the door skins 16A, 16B.

In the embodiment illustrated in FIG. 4, the length L is selected such that the ends of the cap 32 are substantially coterminous with the outer surfaces of the door skins 16A, 16B when the support member 30 is inserted into the edge 22C of the opening as shown. In alternate embodiments, the length L is selected such that the ends of the cap 32 extend beyond the inner surfaces of the door skins 16A, 16B, but do not extend completely to the outer surfaces of the door skins 16A, 16B. In embodiments in which the ends of the cap 32 extend beyond the outer surfaces of the legs 34, 36, the length L may thus be greater than the thickness of the hollow core 24, i.e., greater than the distance between the opposing inner surfaces of the door skins 16A, 16B, and less than or equal to the total thickness of the door 10, i.e., sum of the thickness of the hollow core 24 and the thicknesses of the door skins 16A, 16B, i.e., the distance between the outer surfaces of the door skins 16A, 16B. In embodiments in which the ends of the cap 32 extend beyond the outer surfaces of the legs 34, 36, the cap 32 may serve as an installation guide in that the support member 30 need be advanced into the edge 22C of the opening 22 only until the cap 32 comes into contact with the terminal edges of the door skins 16A, 16B. However, embodiments are contemplated in which the ends of the cap 32 do not extend beyond the outer surfaces of the legs 34, 36, and instead are coterminous with the outer surfaces of the legs 34, 36.

In any case, the cross member 38 is provided to oppose clamping forces applied to the door 10 about the opening 22 by a container assembly of the type illustrated in FIGS. 9-18, and thereby inhibit deformation of the door skins 16A, 16B about the opening 22. In the embodiment illustrated in FIGS. 3 and 4, the support member 30 accomplishes this by maintaining the thickness of the hollow core 24 substantially constant about the opening 22, e.g., along the edges 22A, 22B, 22C, 22D of the opening 22. The distance D between the opposing surfaces of the cap 32 and the cross member 38 will generally be selected to achieve a desired stiffness of the door 10 adjacent to and about the opening 22 so as to maintain the thickness of the hollow core 24 substantially constant about the opening 22. Selection of the distance D may generally be a function of one or more of the dimensions of the door 10, the composition of the door skins 16A, 16B, the dimensions of the container assembly to be mounted to the door 10, the dimensions of one or more mounting structures associated with the container assembly, the weight of the container assembly, the maximum storage capacity, e.g., maximum storage weight, of the container assembly and/or other factors.

In one embodiment, the support member 30 is formed of rigid material which may be natural, synthetic or a combination thereof. In one specific embodiment, the support member 30 is formed from a light weight resin or other plastic material, although other embodiments are contemplated in which the support member 30 may be formed from or include one or more species of wood. In alternate embodiments, the support member 30 may be flexible or semi-flexible, at least along its length (i.e., going into or out of the page in the view illustrated in FIG. 3) so that the support member 30 may be formable, i.e., manipulated, to follow the shape of one or more curved sections of the opening 22 when inserted into a door 10.

Figure 5:
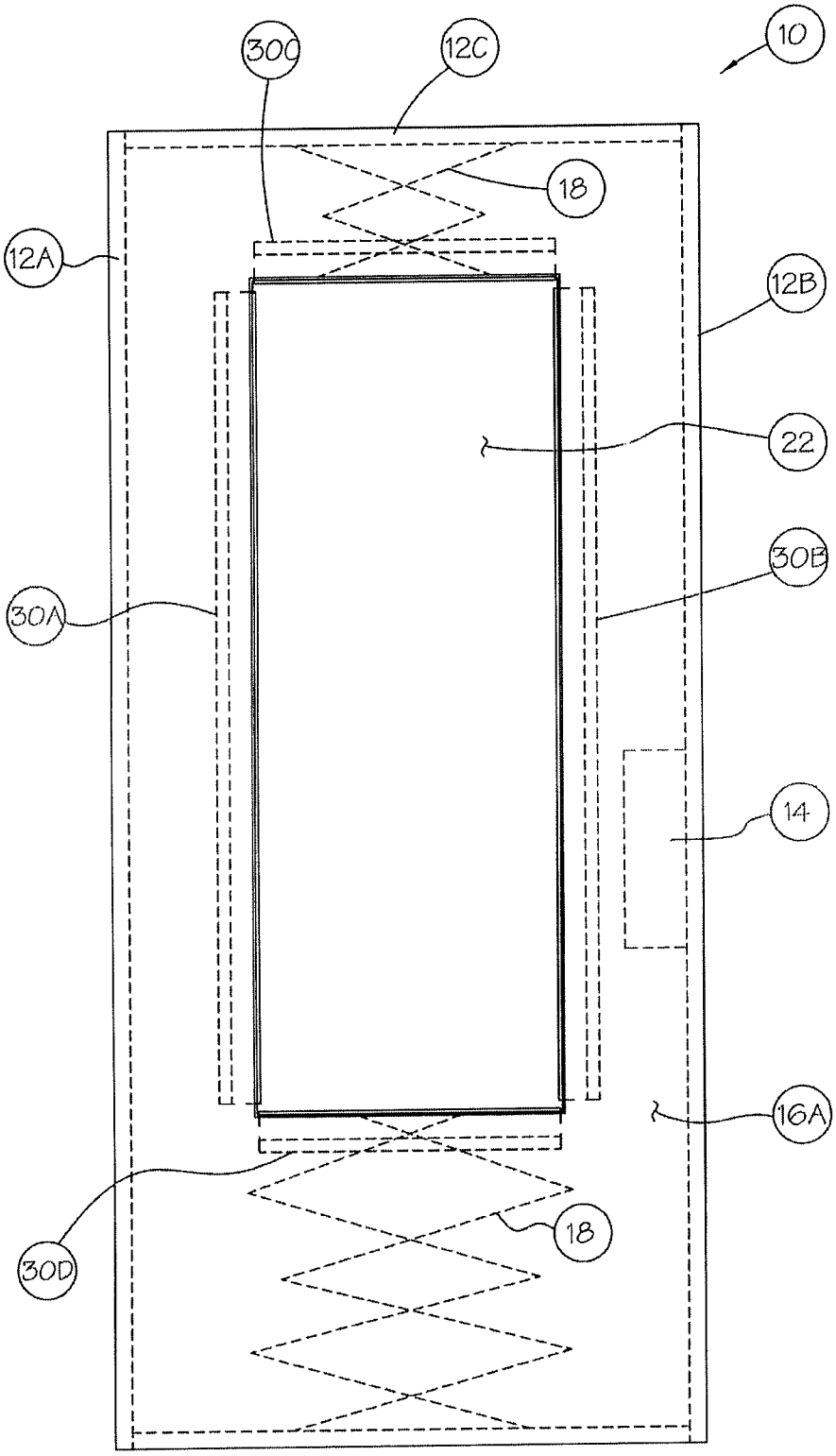
FIG. 5 is a front plan view of the door of FIG. 2 shown with support members inserted into the hollow core along each edge of the opening.

Referring now to FIG. 5, a front plan view is shown of the door 10 of FIG. 1 modified to accommodate mounting thereto of a container assembly of the type illustrated in FIGS. 9-18. In the embodiment illustrated in FIG. 5, a support member 30A, 30B, 30C and 30D, each of the type illustrated in FIGS. 3 and 4, has been inserted into the hollow core 24 of the door 10 along a corresponding edge 22A, 22B, 22C, 22D respectively of the opening 22. The framing components 12A, 12B, 12C, 12D, the lock block 14, the spacing member 18 and the support members 30A, 30B, 30C and 30D are all shown in phantom and are therefore represented in FIG. 5 with dashed lines. It will be noted that in the embodiment illustrated in FIG. 5, the support members 30A, 30B, 30C and 30D do not each extend completely from one end of a respective edge 22A, 22B, 22C, 22D of the opening 22 to the other, and in this sense the support members 30A, 30B, 30C and 30D extend only partially about the opening 22, e.g., in piecewise fashion. However, alternate embodiments are contemplated in which the support members 30A, 30B, 30C and 30D each extend completely from one end of a respective edge 22A, 22B, 22C, 22D of the opening 22 to the other such that the support members extend completely about the opening 22.

As described above with respect to FIG. 2, the opening 22 formed in the door 10 of FIGS. 2-5 is illustratively rectangular in shape in order to receive therein a rectangularly-shaped embodiment of a container assembly, e.g., of the type illustrated by example in FIGS. 9-18. The opening 22 may alternatively be formed in any geometric shape, and any such shape of the opening 22 will generally be dictated by the shape of the container assembly to be mounted to the door 10. Any such geometric shape may generally have N sides, where N may be any positive integer, and a door 10 having any such N-side opening may be modified, generally as just described, by inserting one or more support members 30 into the hollow core 24 along the opening 22. Openings 22 that are circular or oval, for example, may require only a single, flexible or semi-flexible support member, while polygon-shaped openings may require a separate support member for each side of the polygon.

Figure 6:
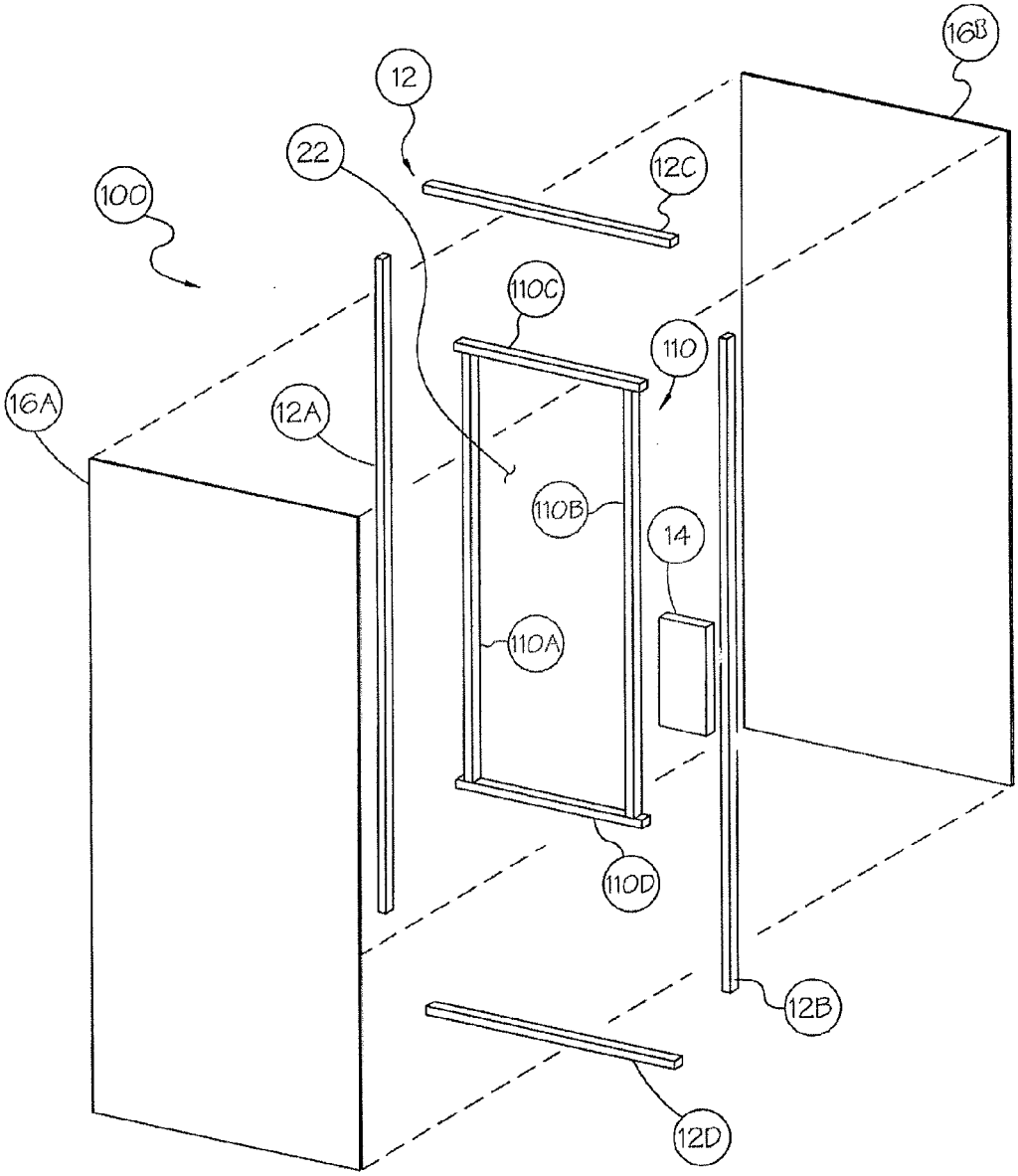
FIG. 6 is an exploded perspective view of an embodiment of a hollow core door including a plurality of embedded frame members.

Referring now to FIG. 6, an exploded perspective view is shown of an embodiment of a hollow core door 100 including one or more frame members affixed to and between the door skins during construction of the door 100. The one or more frame members is/are illustratively positioned to be at or near an opening that may be subsequently defined through the door 100 to accommodate a container assembly of the type illustrated in FIGS. 9-18. As with the support member(s) 30 that may be mounted to a conventional hollow core door 10 as described above, the one or more frame members in the embodiment illustrated in FIG. 6 is/are provided to inhibit deformation of the door skins 16A, 16B at and about such an opening resulting from clamping forces applied to the door 100 by a container assembly of the type illustrated in FIGS. 9-18. In the embodiment illustrated in FIG. 6, such one or more frame members serve to maintain the thickness of the hollow core substantially constant adjacent to and along such an opening when the container assembly is mounted to the door 100 about the opening.

In the embodiment illustrated in FIG. 6, the hollow core door 100 is identical in many respects to the hollow core door 10 described above, and like numbers are therefore used to identify like features of the door 100. For example, the hollow core door 100 of FIG. 6 includes framing 12 about which two opposing door skins 16A and 16B are mounted, and the framing 12 illustratively includes a pair of stiles 12A, 12B spaced apart by, and each connected to, a top rail 12C and a bottom rail 12D. A lock block 14 may be positioned adjacent to one of the stiles, e.g., the stile 12B, to provide for attachment thereto of a conventional door handle and/or lockset. The door skin 16A is attached to one side of the framing 12 and to one side of the lock block 14, and the door skin 16B is attached to the opposite side of the framing 12 and to the opposite side of the lock block 14. The door skins 16A, 16B are attached to the framing 12 such that the outer perimeter of each is coterminous with the outer edge of each stile 12A, 12B and with the outer edge of each rail 12C, 12D.

With the inclusion of one or more frame members within the door 100, as will be described in detail below, such one or more frame members may sufficiently maintain the thickness of the hollow core generally consistent across the surfaces of the door skins 16A, 16B, and unlike the door 10 described above the door skins 16A, 16B of the door 100 therefore may not be susceptible to inward deformation, e.g., sagging. Accordingly, the spacing member 18 may be omitted in some embodiments of the door 100, although the spacing member 18 may alternatively be included within the door 100 if desired.

The door 100 further includes framing 110 positioned within the hollow core and affixed to each of the door skins 16A, 16B, and generally the framing 110 may include one or more frame members. In the embodiment illustrated in FIG. 6, such framing 110 is illustratively configured to accommodate a rectangularly-shaped container assembly, e.g., such as illustrated in FIGS. 9-18, and the framing 110 accordingly includes four such frame members 110A, 110B, 110C and 110D arranged to form a rectangle the size, shape and location of the opening 22 to subsequently formed through the door 100. For example, the frame members 110A and 110B are positioned generally parallel to and inboard of the stiles 12A, 12B, and the frame members 110C and 11D are positioned generally parallel to and inboard of the upper and lower rails 12C and 12D respectively. In one embodiment, the frame members 110A and 110B each abut the frame members 110C and 110D as illustrated in FIG. 6. In some such embodiments, one end of each of the frame members 110A and 110B is attached or affixed to the frame member 110C, and an opposite end of each of the frame members 110A and 110B is attached or affixed to the frame member 110D, although in other embodiments none of the frame members 110A, 110B, 110C, 110D, while in contact with two other frame members as shown, is attached or affixed to another frame member 110A, 110B, 110C, 110D. In alternative embodiments, the frame members 110A, 110B, 110C and 110D may be arranged and oriented as shown in FIG. 6, but with at least one end of one of the frame members 110A, 110B, 110C, 110D not in contact with another frame member 110A, 110B, 110C, 110D. In one specific example of such an alternative embodiment, the frame members 110A, 110B, 110C, 110D are all arranged and oriented as illustrated in FIG. 6, but each of the frame members 110A, 110B, 110C, 110D is shortened at each end relative to that illustrated in FIG. 6 such that none of the frame members 110A, 110B, 110C, 110D contacts another of the frame members.

In one embodiment, the door skins 16A, 16B are affixed to the framing components 12A, 12B, 12C, 12D, to the lock block 14, and to the framing 110, e.g., to the frame members 110A, 110B, 110C, 110D, via a conventional adhesive, although other conventional affixing or attachment methods and/or components may alternatively be used. In any case, the framing 110 is illustratively positioned between the door skins 16A, 16B, and relative to the framing 12 and/or lock block 14, such that an opening 22 subsequently formed through the door 110, which opening will be at least partially bounded by the framing 110, is suitably positioned relative to one or more components of the door 100 to receive therein at least a portion of a container assembly.

Figure 7:
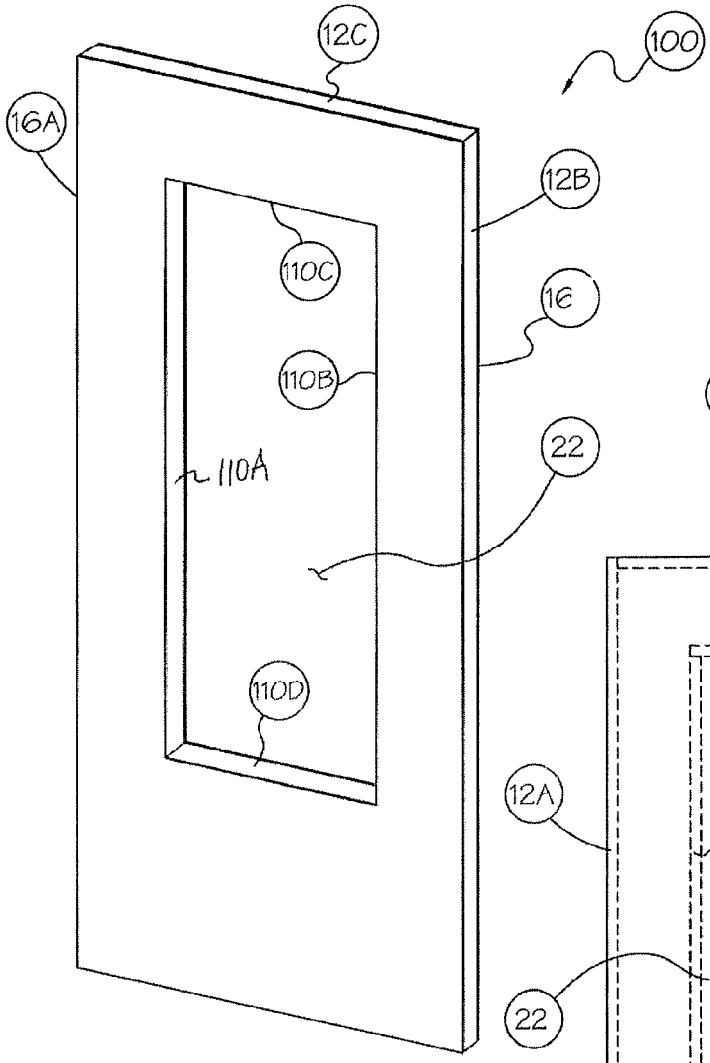
FIG. 7 is a perspective view of the door of FIG. 6 shown with a portion coterminous with the embedded frame members removed.

Referring also now to FIG. 7, a perspective view of the door 100 is shown in assembled form and with the rectangular opening 22 formed therein to receive a rectangularly-shaped embodiment of a container assembly, e.g., of the type illustrated by example in FIGS. 9-18. In alternate embodiments, as described above, the opening 22 may be formed in any geometric shape, and any such shape of the opening 22 will generally be dictated by the shape of the container assembly to be mounted to the door 10. Any such geometric shape may generally have N sides, where N may be any positive integer, and the framing 110 may therefore include one or more frame members as desired to outline, at least partially, the geometric shape of the container assembly. In any case, the framing 110 illustratively defines the outer perimeter of, or is proximate to the outer perimeter of, the opening 22 to be formed through the door 100 after its construction. In the embodiment illustrated in FIG. 7, for example, the opening 22 has been formed in, e.g., cut from, the door 100, and the outer perimeter of the opening 22, i.e., the border of the door skins 16A, 16B which surrounds the opening 22, is defined by the frame members 110A, 110B, 110C, 110D and the corresponding edges of the door skins 16A, 16B affixed thereto.

Generally, the thickness of the hollow core 24, i.e., the distance between the inner surfaces of the door skins 16A, 16B, is determined by the thicknesses of the stiles 12A, 12B and the rails 12C, 12D as described above. In the embodiment illustrated in FIGS. 6 and 7, the thicknesses of the one or more frame members that make up the framing 110 is illustratively identical, or nearly so, to the thicknesses of the stiles 12A, 12B and the rails 12C, 12D so as to maintain substantially uniform thickness of the hollow core 24 across the door skins 16A, 16B. In some embodiments, the framing components 110, e.g., the frame members 110A, 110B, 110C, 110D illustrated in FIG. 7, are formed of wood, although in other embodiments at least one or more of the framing components 110A, 110B, 110C, 110D may be formed of or include one or more synthetic or other organic materials.

Figure 8:
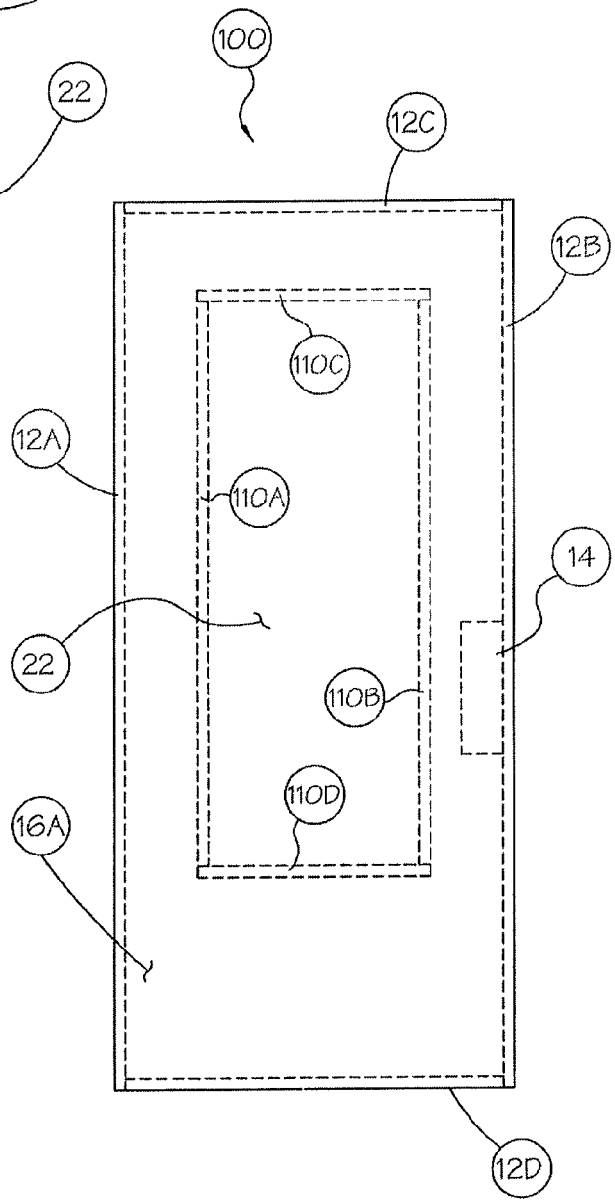
FIG. 8 is a front plan view of the door of FIG. 7.

Referring now to FIG. 8, a front plan view is shown of the door 100 of FIG. 6 modified to define an opening 22 through the door skins 16A, 16B as illustrated in FIG. 7, to accommodate the mounting thereto of a container assembly of the type illustrated in FIGS. 9-18. In the embodiment illustrated in FIG. 8, the framing components 12A, 12B, 12C, 12D, the lock block 14 and the frame members 110A, 110B, 110C and 110D are all shown in phantom and are therefore represented in FIG. 8 with dashed lines. It will be noted that in the embodiment illustrated in FIG. 8, the frame members 110A and 110B frame, and form the borders of, the sides of the opening 22, and the frame members 110C and 110D frame, and form the borders of, the top and bottom respectively of the opening 22.

Figure 9:
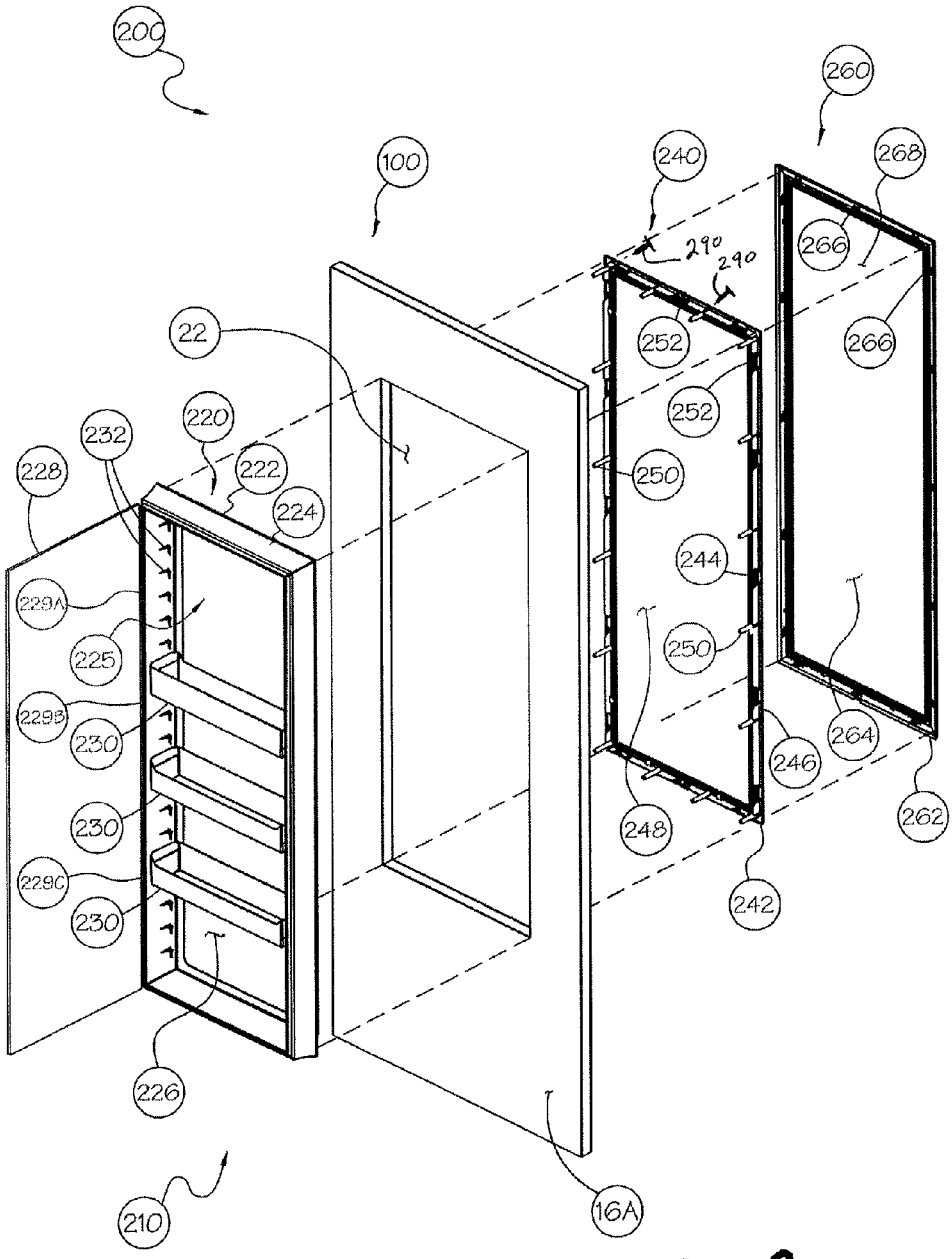
FIG. 9 is an exploded perspective view of a container assembly mountable to a door.

Referring now to FIG. 9, an exploded perspective view is shown of an embodiment of a container assembly 210 mountable to a door via an opening 22 formed through the door. In the illustrated embodiment, the door to which the container assembly 210 is to be mounted is the hollow core door 100 illustrated in FIGS. 6-8, although the door to which the container assembly 210 is to be mounted may alternatively be any door, including for example, but not limited to, the hollow core door 10 modified as illustrated and described herein. In embodiments in which the door to which the container assembly 210 is to be mounted is the hollow core door 10, modified as described with respect to FIGS. 1-5, or the hollow core door 100, as described with respect to FIGS. 6-8, a container assembly 200 is defined which includes the door 10, 100. In any case, the container assembly 210 illustrated in FIG. 9 includes a container unit 220, a mounting frame 240 and a cover frame 260. As will be described in detail below, the container unit 220 is inserted, at least partially, into the opening 22 on one side of the door 100, and the mounting frame 240 is attached to the container unit 220 on the opposite side of the door 100 in a manner that clamps the container unit 220 and the mounting frame 240 to the door 100 about the opening 22. The cover frame 260 is then mounted over the mounting frame 240.

In the embodiment illustrated in FIG. 9, the container unit 220 includes a container 225 having a back panel 226 and at least one side wall 222 extending away from and circumscribing the back panel 226. In the embodiment shown in FIG. 10, the container 225 is rectangular in shape, and the container 225 illustratively includes four interconnected or integral side walls 222 formed in a rectangular shape and attached or affixed to a correspondingly rectangularly shaped back panel 226. The back panel 226 in such embodiments may cover the ends of the side walls 222 to which they are mounted, or the ends of the side walls 222 may alternatively form part of the back panel 226. In any case, the container 225 is sized to pass through the opening 22 defined through the door 100; that is, the opening 22 is formed to be large enough and of the appropriate shape to allow the container 225 to pass therethrough. The one or more side walls 222 may be separate from, and attached or affixed to, the back panel 226, or the one or more side walls 222 and the back panel 226 may alternatively form a unitary body.

The container 225 defines a container interior bounded by opposing front and rear faces of the at least one side wall 222. In the embodiment illustrated in FIG. 9, the container 225 defines a storage area within the container interior between the back panel 226 and a free end of the at least one side wall 222, and the storage area may be configured in a conventional manner, and or with conventional hardware 232 to accommodate and support any number of shelves 230. In one embodiment, a single door 228 is movably mounted to the container 225, e.g., to the free end of one of the side walls 222. In the illustrated embodiment, for example, three hinges 229A, 229B and 229C are attached to and between the free end of one of the side walls 222 and one side of the door 228 such that the door 228 is pivotable between open and closed positions relative to the container 225 to form, together with the container 225, a closed container. In some alternative embodiments, the single door 228 may be replaced with two doors, e.g., conventional bi-fold doors, mounted to opposite side walls 222. In other alternative embodiments, one or more doors may be mounted to the at least one side wall 222 at or near the front face thereof, at or near the rear face thereof, or at or near both of the front and rear faces thereof. In still other alternative embodiments, one or more soft, e.g., flexible or semiflexible, covering may be mounted to or integral with the at least one side wall 222 at or near the front face thereof, at or near the rear face thereof, or at or near both of the front and rear faces thereof.

The container unit 220 further includes a container frame 224 extending from and about an outer surface of the side wall 222. The container frame 224 may be attached to or integral with the side wall 222 of the container 225. In the illustrated embodiment, the frame 224 extends outwardly away from all of the sidewalls 222 about the other periphery of the container 225, e.g., in a direction generally parallel with the back panel 226 and generally perpendicular to the side walls 222, and defines an outer terminal portion 224A (see FIGS. 10 and 17) that is sized and configured to abut the door 100, i.e., to extend about the periphery of the opening 22 defined through the door and abut one of the door skins 16A, 16B, about the opening 22. In some embodiments, a portion of the container frame 224 may extend along an outer surface of the side walls 222 to the back panel 226, and in such embodiments the dimensions of the opening 22 should take this into account to ensure that the combination of the container 225 and any such portion of the container frame 224 can pass through the opening 22.

Figure 10:
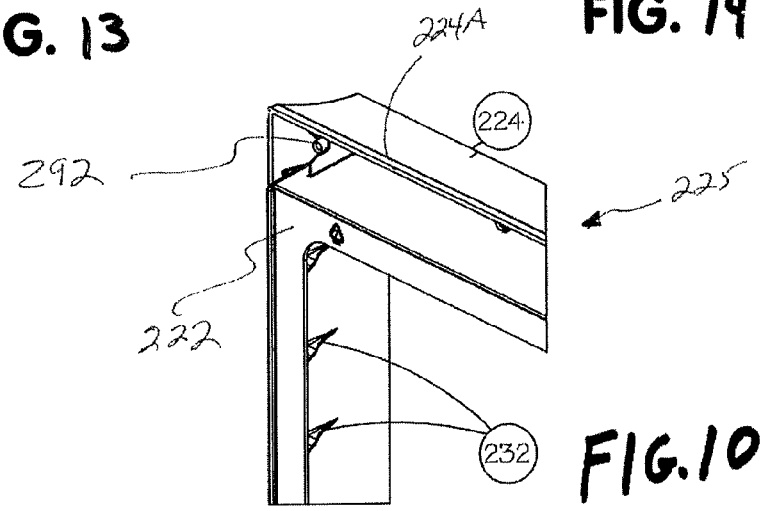
FIG. 10 is a perspective view of a portion of the container illustrated in FIG. 9.

The container 225 is illustratively formed of a rigid material which may be natural, synthetic or a combination thereof. In one embodiment, the container 225 is formed from a light weight resin or other plastic material in which the at least one side wall 222, the container frame 224 and the back panel 226 are integrally formed such that the at least one side wall 222, the container frame 224 and the back panel 226 together form a unitary structure. FIG. 10 illustrates one example embodiment of such an integral structure in which the back panel 226 is omitted to illustrate more clearly example shelving support structures 232 also integrally formed in the at least one side wall 222. In other embodiments one or more of the walls forming the at least one sidewall 222, and/or one or both of the container frame 224 and the back panel 226, in embodiments that include the back panel 226, may be formed separately of like or dissimilar materials and attached or otherwise mounted to remaining components to form the container 225.

Figure 11:
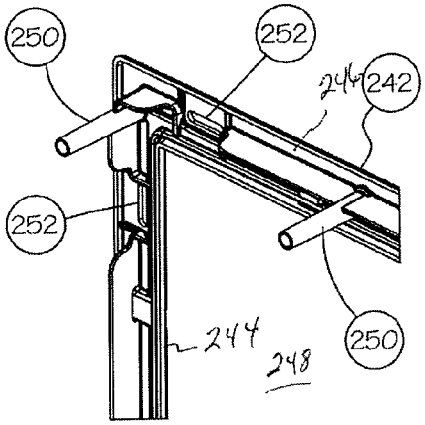
FIG. 11 is a perspective view of a portion of an inner surface of the mounting frame illustrated in FIG. 9.
Figure 12:
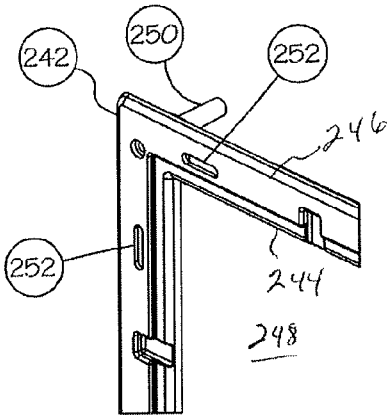
FIG. 12 is a perspective view of a portion an outer surface of the mounting frame illustrated in FIG. 9.

The mounting frame 240 shown in FIGS. 9, 11 and 12 illustratively includes a frame member 242 defining an inner terminal portion 244 and an outer terminal portion 246, and the inner terminal portion 244 defines an opening 248, e.g., a rectangular opening in the illustrated embodiment, through the frame member 242. In embodiments of the container 225 that include the back panel 226, the inner terminal portion 244 of the frame member 242 is sized and configured to abut the outer, e.g. rear, surface of the back panel 226 of the container 225 about and adjacent to an outer periphery of the back panel 226 when the mounting frame 240 is mounted to the container unit 210, e.g., such that the inner periphery of the frame member 242 covers at least a portion of the rear surface of the back panel 226 about its outer periphery. In embodiments of the container 225 that do not include the back panel 226, the inner terminal portion 244 of the frame member 242 is sized and configured to extend over the opening 22 about the periphery of the opening 22, and in one embodiment to abut the rear face of the at least one side wall 222 about and adjacent to an outer periphery of the rear face of the sidewall 222 when the mounting frame 240 is mounted to the container unit 210, e.g., such that the inner periphery of the frame member 242 covers at least a portion of the rear face of the at least one sidewall 222 about its outer periphery. The outer terminal portion 246 of the frame member 242 is sized and configured to abut the door 100 about the opening 22 defined through the door 100, e.g., sized to be larger than the opening 22 and configured to abut the door skin 16A, 16B completely about the opening 222.

When the container unit 210 is inserted into the opening 22 on one side of the door, e.g., on the side defined by the door skin 16A as illustrated in FIG. 9, the container 225 extends partially into the opening 22, and the outer terminal portion of the container frame 224 abuts the door skin 16A about the periphery of the opening 22. When the mounting frame 240 is brought into contact with the opposite side of the door, e.g., on the side defined by the door skin 16B, the outer terminal portion of the frame member 242 abuts the door skin 16B about the periphery of the opening 22, and the inner terminal portion of the frame member 242 abuts the outer surface of the back panel 226 of the container 225 about and adjacent to an outer periphery of the back panel 226. At least one conventional fixation member 290, e.g., screw, bolt or the like, is then passed through the mounting frame 240, e.g., through one of the fixation passageways 250 defined about the frame member 242, into engagement with a corresponding fixation passageway 292 defined about the container frame 224 between its outer terminal portion 224A and the side walls 222, i.e., without contacting either the door 100 or the container 225. Illustratively, a number of such fixation members 290 are used about the perimeter of the mounting frame 240 and container frame 224, e.g., two or more on each of the four sides, and as the fixation members are advanced into and secured to the container frame 224, the outer terminal portions 224A and 246 of the two frames 224 and 240 respectively, and therefore also the container 225, are clamped to the door about the periphery of the opening 22 with a portion of the door 100 about the periphery of the opening 22 trapped between the frames 224 and 240. The doors 10 and 100 illustrated in FIGS. 1-8 are configured as described to withstand such clamping forces without deforming the door skins 16A, 16B inwardly and thereby potentially damaging the door 10, 100.

Figure 13:
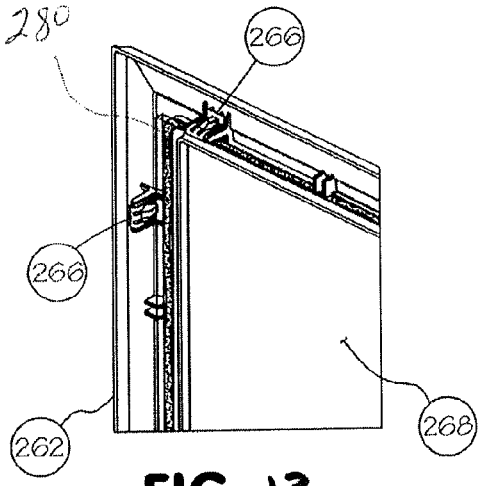
FIG. 13 is a perspective view of a portion of an inner surface of the cover frame illustrated in FIG. 9.
Figure 14:
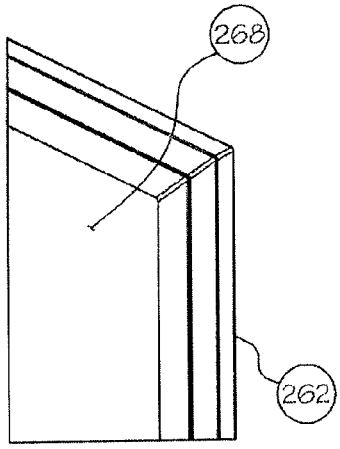
FIG. 14 is a perspective view of a portion of an outer surface of the cover frame illustrated in FIG. 9.

The cover frame 260 shown in FIGS. 9, 13 and 14 illustratively includes a frame member 262 defining an opening 264 therethrough, e.g., a rectangular opening 264 in the illustrated embodiment. In the illustrated embodiment, the opening 264 is substantially the same dimensions as the opening 248 defined through the mounting frame 240, and the frame member 262 is configured to overlay, e.g., so as to hide, the mounting frame member 242. The cover frame member 262 further includes one or more conventional attachment or fixation members 266 sized and configured to be received within and engage with one or more corresponding openings 252 formed in the mounting frame member 242. In some embodiments, an outer panel 268 may be positioned, e.g., trapped or clamped, between the cover frame 260 and the mounting frame 240, and such an outer panel 268 may be formed of any desired material or materials. In one embodiment, the outer panel 268 is transparent such that the outer surface of the back panel 226 of the container 225 can be seen, or such that a poster, photograph, painting or other work of art or other graphic and/or alphanumeric depiction, can be positioned between the outer surface of the back panel 226 of the container 225 and the outer panel 268 for viewing through the outer panel 268. In such embodiments, the outer panel 268 may be formed of any conventional transparent material, examples of which include, but should not be limited to, glass, a transparent plastic material, or the like. In other embodiments, the outer panel 268 may be or include a conventional chalk board, magnetic chalk board, white board, or the like. In still other embodiments, the frames 240 and 260 may form a single, unitary structure.

Figure 15:
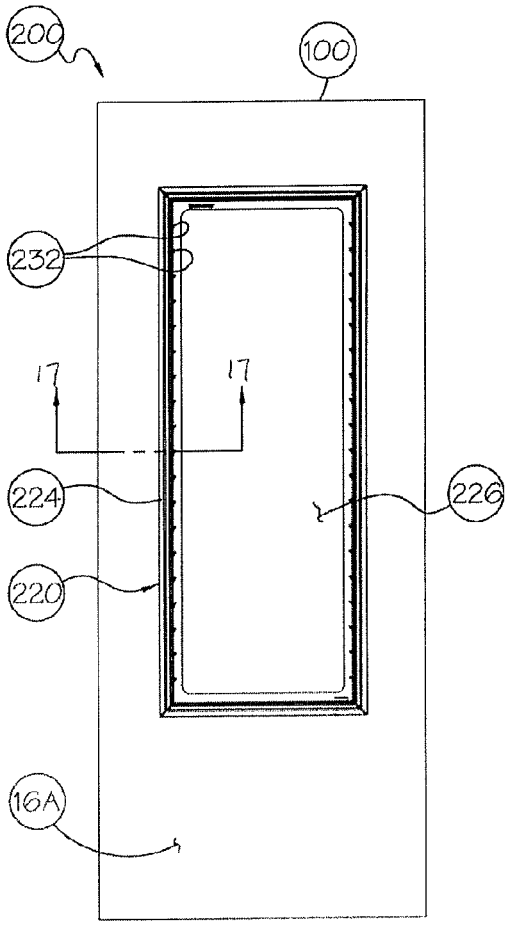
FIG. 15 is a front plan view of the assembly of FIG. 9 shown in assembled form.
Figure 16:
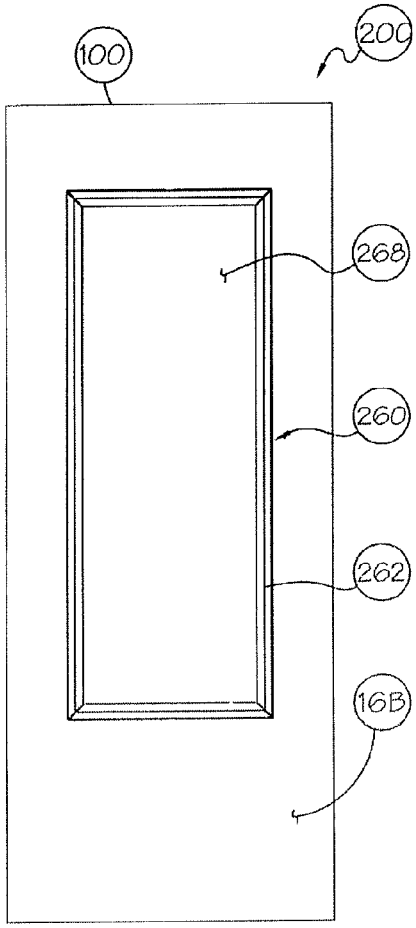
FIG. 16 is a rear plan view of the assembly of FIG. 9.
Figure 17:
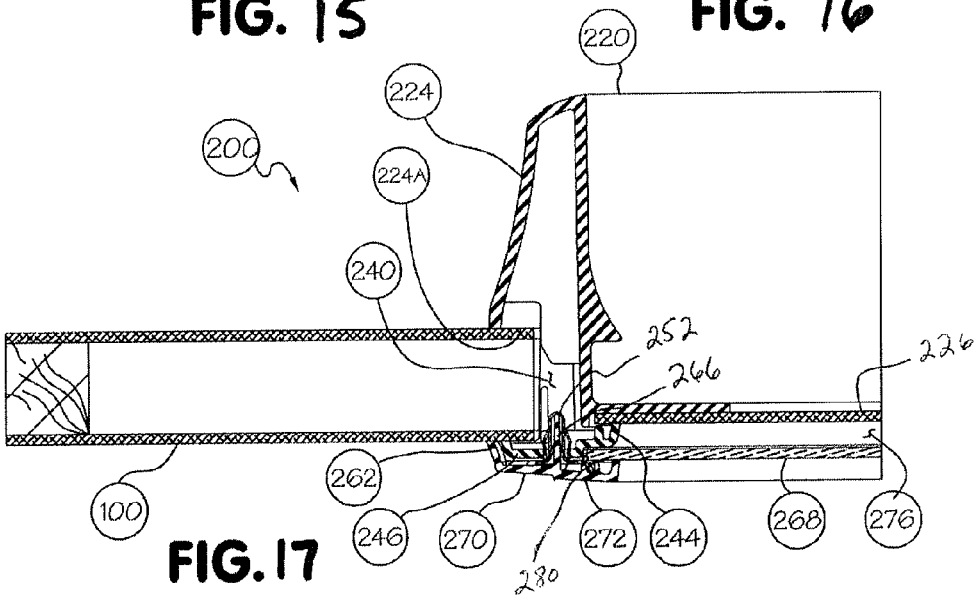
FIG. 17 is a cross-sectional view of the assembly of FIG. 15 viewed along section lines 17-17.

In FIGS. 15 and 16, front and rear plan views respectively are shown of the assembled container assembly 200. In FIG. 17, which is a cross section of the assembly 200 as viewed along section lines 17-17 of FIG. 15, the frame member 262 of the cover frame 260 is illustrated as defining an outer terminal portion 270 that is sized and configured to abut the door 100 about the outer terminal portion 246 of the mounting frame 240, and an inner terminal portion 272 that is sized and configured to abut the inner terminal portion 244 of the mounting frame 240 such that the outer terminal portion 270 of the cover frame 260 completely hides the outer terminal portion 246 of the mounting frame 240 from view. In alternative embodiments, the inner terminal portion 272 of the cover frame 260 may be sized and configured to abut the outer surface of the back panel 226 of the container 225 about the inner terminal portion 244 of the mounting frame 240 such that the inner terminal portion 272 completely hides the inner terminal portion 244 of the mounting frame 240. In either case, the outer panel 268 is shown sized to be received between the inner terminal portions 244 and 272 of the mounting and cover frames 240 and 260 respectively such that the outer periphery of the outer panel 268 is trapped between the inner terminal portions 244, 272. In the illustrated assembly, a space 276 is thus defined by the inner terminal portion 244 between the outer or rear surface of the back panel 226 and the outer panel 268. Illustratively, a conventional sealing medium 280 may be disposed between the outer panel 268 and the cover frame 260 to form a seal between the outer panel 268 and the cover frame 260. In the embodiment illustrated in FIG. 13, for example, the sealing medium 280 is applied to the cover frame member 262 about its inner periphery. Alternatively or additionally, the sealing medium 280 may be disposed between the outer panel 268 and the mounting frame 240 to form a seal between the outer panel 268 and the mounting frame 240.

In FIG. 18, an alternate embodiment 200' is shown in which the container 225' does not include a back panel 226. In FIG. 19, another alternate embodiment 200" is shown in which the container unit 210 is replaced with another mounting frame 240' and another cover frame 260' as illustrated and described above. In this embodiment, the two mounting frames 240 and 240' are clamped to the door 10, 100 about the opening 222 as described above, e.g., using one or more fixation members 290, and the two cover frames 260 and 260' are mounted to respective ones of the mounting frames 240 and 240'. A first outer panel 268 may be mounted between the mounting frame 240 and the cover frame 260 on one side of the door 10, 100, and a second outer panel 268' may be mounted between the mounting frame 240' and the cover frame 260'. As described above, the mounting frame 240 and the cover frame 260 may be integral or separate units, and/or the mounting frame 240' and the cover frame 260' may be integral or separate units.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A combination door and container assembly comprising:

a hollow core door having a first door skin and a second door skin opposite the first door skin and defining a first space having a thickness between the first and second door skins, the hollow core door defining an opening therethrough that extends through the first and second door skins, a container having a side wall defining and circumscribing a container interior, the container sized to pass through the opening defined through the door, a first frame extending from and about the side wall and defining an outer terminal portion sized and configured to abut the door about the opening, a second frame defining an outer terminal portion sized and configured to abut the door about the opening and an inner terminal portion sized and configured to extend over at least a portion of the opening about a periphery of the opening, at least a first fixation member to secure the first frame to the second frame with the container extending into the opening and with a portion of the door adjacent to the opening positioned between the outer terminal portions of the first and second frames to clamp the container assembly to the door about the opening, and at least one support member sized to be received within the first space at least partially about the opening, the at least one support member to maintain the thickness of the first space constant adjacent to and along the opening with the at least a first fixation member securing the first frame to the second frame, the at least one support member configured to be inserted into the first space at least partially about the opening after the opening is defined through the door, the at least one support member comprising a cap having a width that is greater than the thickness of the first space and less than or equal to a thickness of the door defined between outer surfaces of the first and second skins and a door insertion portion extending from the cap, the door insertion portion configured to extend into the first space with the cap abutting terminal ends of the first and second door skins defined by the opening.

2. The combination door and container assembly of claim 1 wherein an inner portion of the first frame extends along and is attached to an outer surface of the side wall, and wherein a combination of the container and the inner portion of the first frame is sized to pass through the opening defined through the door.

3. The combination door and container assembly of claim 1 wherein the first frame is integral with the side wall such that the first frame and the side wall together form a unitary structure.

4. The combination door and container assembly of claim 1 wherein the side wall defines a front face and a rear face with the container interior defined between the front and rear faces, and wherein the container comprises a panel defining a terminal wall of the container interior, and wherein the panel is one of attached to one of the front face and rear face of the side wall and integral with the one of the front face and rear face of the side wall.

5. The combination door and container assembly of claim 1 wherein the side wall defines a front face and a rear face with the container interior defined between the front and rear faces, and wherein the container comprises at least one door or soft covering mounted to the side wall at or adjacent to at least one of the front face and the rear face.

6. The combination door and container assembly of claim 1 wherein the container assembly comprises at least one shelf support member configured to support at least one shelf positioned within the container interior.

7. The combination door and container assembly of claim 1 wherein the first and second frames are configured to receive the at least a first fixation member such that the at least a first fixation member secures the first frame to the second frame without contacting the door and without contacting the container.

8. The combination door and container assembly of claim 1 further comprising:

a third frame to overlay and cover the second frame, and at least a second fixation member to secure the third frame to the second frame.

9. The combination door and container assembly of claim 8 further comprising an outer panel sized to be received between the second and third frames, the second and third frames configured to trap the outer panel therebetween.

10. The combination door and container assembly of claim 9 further comprising a sealing medium disposed between the outer panel and at least one of the second and third frames to form a seal between the outer panel and the at least one of the second and third frames.

11. The combination door and container assembly of claim 9 wherein the outer panel is one of a chalk board, a magnetic chalk board, a white board, and a transparent panel.

12. The combination door and container assembly of claim 9 wherein the third frame defines an outer terminal portion sized and configured to abut the door about the outer terminal portion of the second frame, and an inner terminal portion sized and configured to contact the outer panel and trap the outer panel against the inner terminal portion of the second frame about the inner terminal portion of the second frame.

13. The combination door and container assembly of claim 8 wherein the at least a second fixation member is integral with at least one of the second frame and the third frame.

14. The combination door and container assembly of claim 9 wherein the outer panel defines an outer periphery, and wherein the inner terminal portion of the second frame is configured to abut one surface of the outer panel about the outer periphery thereof and the inner terminal portion of the third frame is configured to abut an opposite surface of the outer panel about the outer periphery thereof.

15. The combination door and container assembly of claim 1 wherein the opening defined through the door is a rectangular opening having a top, a bottom, a first side between the top and bottom, and a second side between the top and bottom and opposite the first side, and wherein the at least one support member comprises a first support member configured to be inserted into the first space along the top of the rectangular opening and between the first and second sides, a second support member configured to be inserted into the first space along the bottom of the rectangular opening and between the first and second sides, a third support member configured to be inserted into the first space along the first side and between the top and bottom, and a fourth support member configured to be inserted into the first space along the second side and between the top and bottom.

16. The combination door and container assembly of claim 1 wherein the door comprises a spacing member positioned within the first space to maintain the thickness of the first space consistent across the hollow core door, and wherein the at least one support member comprises a spacing member displacement portion configured to displace the spacing member from the first space adjacent to the opening defined through the door when the at least one support member is inserted into the first space.

17. The combination door and container assembly of claim 16 wherein the door insertion portion defines the spacing member displacement portion, and wherein the door insertion portion is configured to extend into the first space with the spacing member displacement portion displacing the spacing member from the first space adjacent to the opening defined through the door.

18. The combination door and container assembly of claim 1 wherein the opening defined through the door is a rectangular opening having a top, a bottom, a first side between the top and bottom, and a second side between the top and bottom and opposite the first side, and wherein the at least one support member comprises a first frame member extending along and substantially coterminous with the top of the opening when the opening is defined through the door, a second frame member extending along and substantially coterminous with the bottom of the opening when the opening is defined through the door, a third frame member extending along and substantially coterminous with the first side of the opening when the opening is defined through the door, and a fourth frame member extending along and substantially coterminous with the second side of the opening when the opening is defined through the door.

19. The combination door and container assembly of claim 18 wherein the first and second frame members are each joined to each of the third and fourth frame members.

20. The combination door and container assembly of claim 18 wherein none of the first, second, third and fourth frame members is joined with any others of the first, second, third and fourth frame members.

21. The combination door and container assembly of claim 18 wherein at least one of the first, second, third and fourth frame members is joined to another one of the first, second, third and fourth frame members.

22. The combination door and container assembly of claim 1 wherein the side wall comprises a top panel, a bottom panel, a first side wall and a second side wall, the top and bottom panels each joined to or integral with each of the first and second side walls to form a rectangular container.

23. A combination door and container assembly comprising:

a hollow core door having a first door skin and a second door skin opposite the first door skin and defining a first space having a thickness between the first and second door skins, the hollow core door defining an opening therethrough that extends through the first and second door skins.

a spacing member positioned within the first space to maintain the thickness of the first space consistent across the hollow core door, a container having a side wall defining and circumscribing a container interior, the container sized to pass through the opening defined through the door, a first frame extending from and about the side wall and defining an outer terminal portion sized and configured to abut the door about the opening, a second frame defining an outer terminal portion sized and configured to abut the door about the opening and an inner terminal portion sized and configured to extend over at least a portion of the opening about a periphery of the opening, at least a first fixation member to secure the first frame to the second frame with the container extending into the opening and with a portion of the door adjacent to the opening positioned between the outer terminal portions of the first and second frames to clamp the container assembly to the door about the opening, and at least one support member sized to be received within the first space at least partially about the opening, the at least one support member to maintain the thickness of the first space constant adjacent to and along the opening with the at least a first fixation member securing the first frame to the second frame, the at least one support member comprising a spacing member displacement portion configured to displace the spacing member from the first space adjacent to the opening defined through the door as the at least one support member is received within the first space.

24. A combination door and container assembly comprising:

a hollow core door having a first door skin and a second door skin opposite the first door skin and defining a first space having a thickness between the first and second door skins, the hollow core door defining an opening therethrough that extends through the first and second door skins, a container having a side wall defining and circumscribing a container interior, the container sized to pass through the opening defined through the door, a first frame extending from and about the side wall and defining an outer terminal portion sized and configured to abut the door about the opening, a second frame defining an outer terminal portion sized and configured to abut the door about the opening and an inner terminal portion sized and configured to extend over at least a portion of the opening about a periphery of the opening, at least a first fixation member to secure the first frame to the second frame with the container extending into the opening and with a portion of the door adjacent to the opening positioned between the outer terminal portions of the first and second frames to clamp the container assembly to the door about the opening, and at least one support member sized to be received within the first space at least partially about the opening, the at least one support member to maintain the thickness of the first space constant adjacent to and along the opening with the at least a first fixation member securing the first frame to the second frame, wherein the at least one support member is affixed to inner surfaces of the first and second door skins before the opening is defined through the door, the at least one support member positioned relative to the first and second door skins such that the at least one support member extends at least partially about, at or near, the opening when the opening is defined through the door.

25. A combination door and container assembly comprising:

a hollow core door having a first door skin and a second door skin opposite the first door skin and defining a first space having a thickness between the first and second door skins, the hollow core door defining an opening therethrough that extends through the first and second door skins, a container having a side wall defining and circumscribing a container interior, the container sized to pass through the opening defined through the door, the side wall defining a front face and a rear face, and a rear panel attached to or integral with the rear face of the side wall, a first frame extending from and about the side wall and defining an outer terminal portion sized and configured to abut the door about the opening, a second frame defining an outer terminal portion sized and configured to abut the door about the opening and an inner terminal portion sized and configured to extend over at least a portion of the opening about a periphery of the opening, at least a first fixation member to secure the first frame to the second frame with the container extending into the opening and with a portion of the door adjacent to the opening positioned between the outer terminal portions of the first and second frames to clamp the container assembly to the door about the opening, at least one support member sized to be received within the first space at least partially about the opening, the at least one support member to maintain the thickness of the first space constant adjacent to and along the opening with the at least a first fixation member securing the first frame to the second frame, and an outer panel defining a first surface and a second surface opposite the first surface, the first surface of the outer panel facing the rear panel of the container, the inner terminal portion of the second frame positioned between the first surface of the outer panel and the rear face of the container to define a second space therebetween.

26. The combination door and container assembly of claim 25 wherein the inner terminal portion of the second frame abuts both the rear panel of the container and the first surface of the outer panel.

* * * * *